US009713382B2

(12) United States Patent
Rogers

(10) Patent No.: US 9,713,382 B2
(45) **Date of Patent: *Jul. 25, 2017**

(54) CHAIR WITH EXTENDABLE AND RETRACTABLE GANGING SYSTEM

(71) Applicant: Mity-Lite, Inc., Orem, UT (US)

(72) Inventor: Grant Rogers, Orem, UT (US)

(73) Assignee: Mity-Lite, Inc., Orem, UT (US)

( * ) Notice: Subject to any disclaimer, the term of this patent is extended or adjusted under 35 U.S.C. 154(b) by 195 days.

This patent is subject to a terminal disclaimer.

(21) Appl. No.: 14/752,628

(22) Filed: Jun. 26, 2015

(65) Prior Publication Data

US 2015/0296986 A1 Oct. 22, 2015

Related U.S. Application Data

(63) Continuation-in-part of application No. 14/075,141, filed on Nov. 8, 2013, now Pat. No. 9,351,577.

(60) Provisional application No. 62/021,977, filed on Jul. 8, 2014.

(51) Int. Cl.

| | |
|---|---|
| ***A47C 1/124*** | (2006.01) |
| ***A47C 3/04*** | (2006.01) |
| ***A47C 7/18*** | (2006.01) |

(52) U.S. Cl.

CPC ..... *A47C 1/124* (2013.01); *A47C 3/04* (2013.01); *A47C 7/185* (2013.01)

(58) Field of Classification Search

CPC ..... A47C 3/04; A47C 7/185; A47C 1/124

See application file for complete search history.

(56) References Cited

U.S. PATENT DOCUMENTS

| | | | |
|---|---|---|---|
| 1,674,220 | A | 6/1928 | Percival |
| 2,259,534 | A | 10/1941 | Reynolds et al. |
| 3,117,819 | A | 1/1964 | Kudriavetz |
| 3,455,605 | A | 7/1969 | Anderson |
| 3,639,001 | A | 2/1972 | Anderson |
| 3,981,534 | A | 9/1976 | Wilton |
| 4,978,168 | A | 12/1990 | Piretti |
| 5,282,669 | A | 2/1994 | Barile |
| 5,524,963 | A | 6/1996 | Barile |
| 5,632,524 | A | 5/1997 | Ikeda et al. |
| 5,954,396 | A | 9/1999 | Kemnitzer |
| 5,997,084 | A | 12/1999 | Brile, Jr. et al. |
| 6,135,562 | A | 10/2000 | Infanti |
| 6,805,412 | B2 | 10/2004 | Roth |

(Continued)

OTHER PUBLICATIONS

Banquet Chairs, MityLite, Grand Series, 2 Pages, Nov. 4, 2014.

(Continued)

*Primary Examiner* — David R Dunn
*Assistant Examiner* — Tania Abraham
(74) *Attorney, Agent, or Firm* — Thorpe, North & Western, LLP

(57) ABSTRACT

A chair has a frame with legs, a seat hoop carried by the legs, and a backrest extending above the seat hoop. A seat is carried by the seat hoop of the frame, and has a seat base with a cushion. A perimeter lip circumscribes the seat base and rests over the seat hoop. The seat base has a flexible and resilient corrugated interior capable of deflecting under weight and returning when the weight is removed. An annular bottom projection projects from the seat base between the perimeter lip and the corrugated interior and into the seat hoop, and has an annular bottom surface substantially flush with the lower surface of the seat hoop.

20 Claims, 8 Drawing Sheets

(56) References Cited

U.S. PATENT DOCUMENTS

| | | | |
|---|---|---|---|
| 6,935,698 | B1 | 8/2005 | Chen |
| 7,654,617 | B2 | 2/2010 | Farnsworth |
| 8,511,753 | B2 | 8/2013 | Huang |
| 2009/0284057 | A1 | 11/2009 | Kulish |

OTHER PUBLICATIONS

MityLite, Grand Series, Banquet Chairs, 4 Pages, accessed Nov. 4, 2014.
Mode, Human Scale, 4 Pages, accessed May 23, 2014.
Picture Perfect, MTS, 3 Pages, © 2011.
The Vista Collection, Symmetry and Elegance, 6 Pages, accessed May 23, 2014.

CHAIR WITH EXTENDABLE AND RETRACTABLE GANGING SYSTEM

PRIORITY CLAIM(S) AND RELATED APPLICATION(S)

Priority is claimed to U.S. Provisional Patent Application Ser. No. 62/021,977, filed Jul. 8, 2014, which is hereby incorporated herein by reference in its entirety. This is a continuation-in-part of U.S. patent application Ser. No. 14/075,141, filed Nov. 8, 2013, which is hereby incorporated herein by reference in its entirety.

BACKGROUND

Field of the Invention

The present invention relates generally to chairs. More particularly, the present invention relates to stacking and/or banquet style chairs.

Related Art

Banquet type chairs are often used in multi-purpose rooms to provide various different configurations and numbers, and can be stacked for storage when not needed. In addition, such chairs can have a thick foam cushion for comfort for extended periods of sitting.

Another type of chair has been provided with a corrugated flexing arrangement. For example, see U.S. Pat. No. 7,654,617.

Ganging systems are generally employed to interlock chairs together into rows or other suitable configurations.

SUMMARY OF THE INVENTION

It has been recognized that it would be advantageous to develop a chair that provides a ganging system that can be hidden or to make a ganging system less prominent when it is not being used. Hence, an extendable and retractable ganging system is described herein that can generally be used with a chair.

The invention provides a chair with a ganging member. The chair has a frame with legs, a seat hoop carried by the legs, and a backrest extending above the seat hoop. The seat hoop has a thickness between upper and lower surfaces. A seat is carried by the seat hoop of the frame, and has a seat base with a cushion thereon. The seat base has a perimeter lip circumscribing the seat base and resting over the seat hoop. The ganging member is affixed to the seat base, and extends laterally beyond the seat hoop between the perimeter lip of the seat base and the seat hoop of the frame. The ganging member is configured to engage another ganging member of an adjacent chair.

In accordance with a more detailed aspect of the invention, the ganging member can be slidably coupled to the seat base so that the ganging member can extend and retract with respect to the seat base. The ganging member can comprise a rod bent in a U-shape and having free ends affixed to the seat base, horizontal arms resting over the seat hoop, and a closed end bent to extend vertically. A notch can be formed in a lower edge of the seat base of the seat and can form an aperture between the notch and the seat hoop of the frame. The ganging member can extend from the aperture between the seat base of the seat and the seat hoop of the frame. A guide can be disposed on a bottom of the seat base of the seat and can clamp the ganging member to the bottom of the seat base. A bumper can be affixed to the seat base and can extend laterally beyond the seat hoop between the perimeter lip of the seat base and the seat hoop of the frame to abut to an adjacent chair or corresponding bumper of the adjacent chair. The ganging member can comprise: 1) at least one male-type ganging member disposed on one side of the seat base; and 2) at least one female-type ganging member disposed on another opposite side of the seat base. The at least one male-type ganging member can be configured to engage at least one female-type ganging member of an adjacent chair. The at least one female-type ganging member can be configured to engage at least one male-type ganging member of another adjacent chair. The adjacent male-type and female-type ganging members can engage and interlock.

In addition, the invention provides a chair with a ganging member. The chair has a frame with legs, a seat hoop carried by the legs, and a backrest extending above the seat hoop. The seat hoop has a thickness between upper and lower surfaces. A seat is carried by the seat hoop of the frame, and has a seat base with a cushion thereon. A perimeter lip circumscribes the seat base and resting over the seat hoop. A bottom projection projects from the seat base and into the seat hoop. The bottom projection has a bottom surface substantially flush with the lower surface of the seat hoop. The ganging member is affixed to the seat base and extends laterally beyond the seat hoop between the perimeter lip of the seat base and the seat hoop of the frame to engage another ganging member of an adjacent chair. A notch is formed in a lower edge of the seat base of the seat and forms an aperture between the notch and the seat hoop of the frame. The ganging member extends from the aperture between the seat base of the seat and the seat hoop of the frame. The ganging member is slidably coupled to the seat base so that the ganging member can extend and retract with respect to the seat base.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
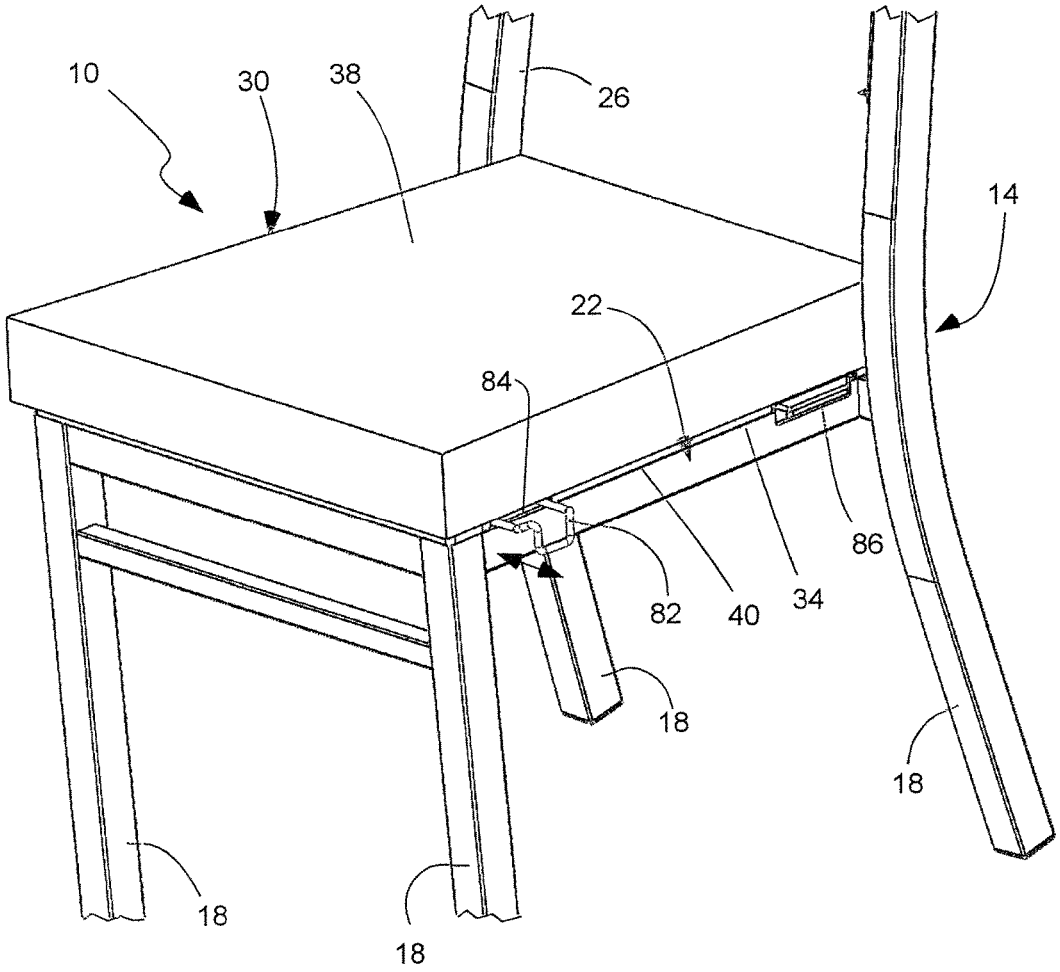
FIG. 1 is a partial perspective view of a chair in accordance with an embodiment of the present invention.
Figure 2:
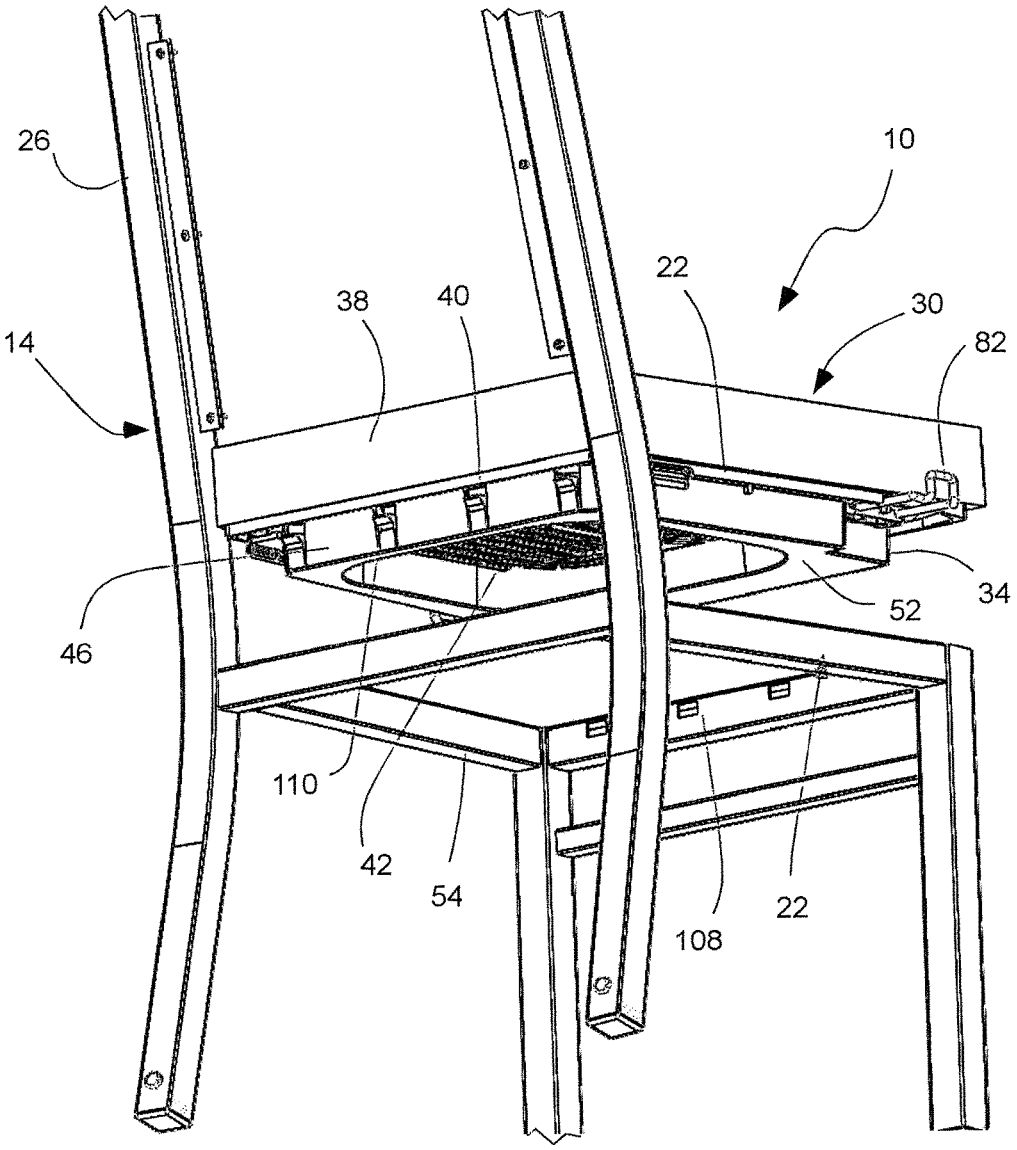
FIG. 2 is a partial exploded perspective view of the chair of FIG. 1.
Figure 3:
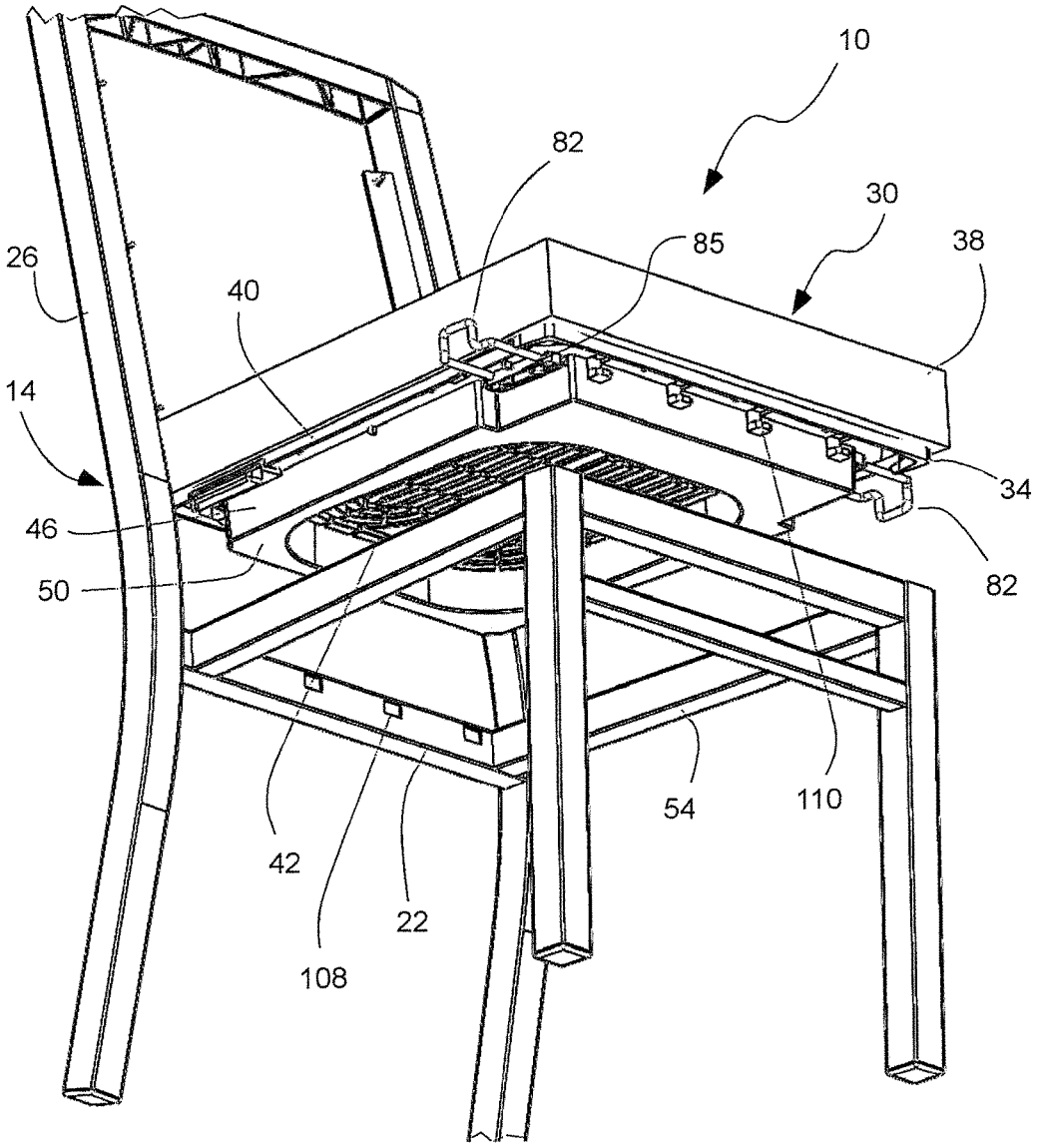
FIG. 3 is a partial exploded perspective view of the chair of FIG. 1.
Figure 4:
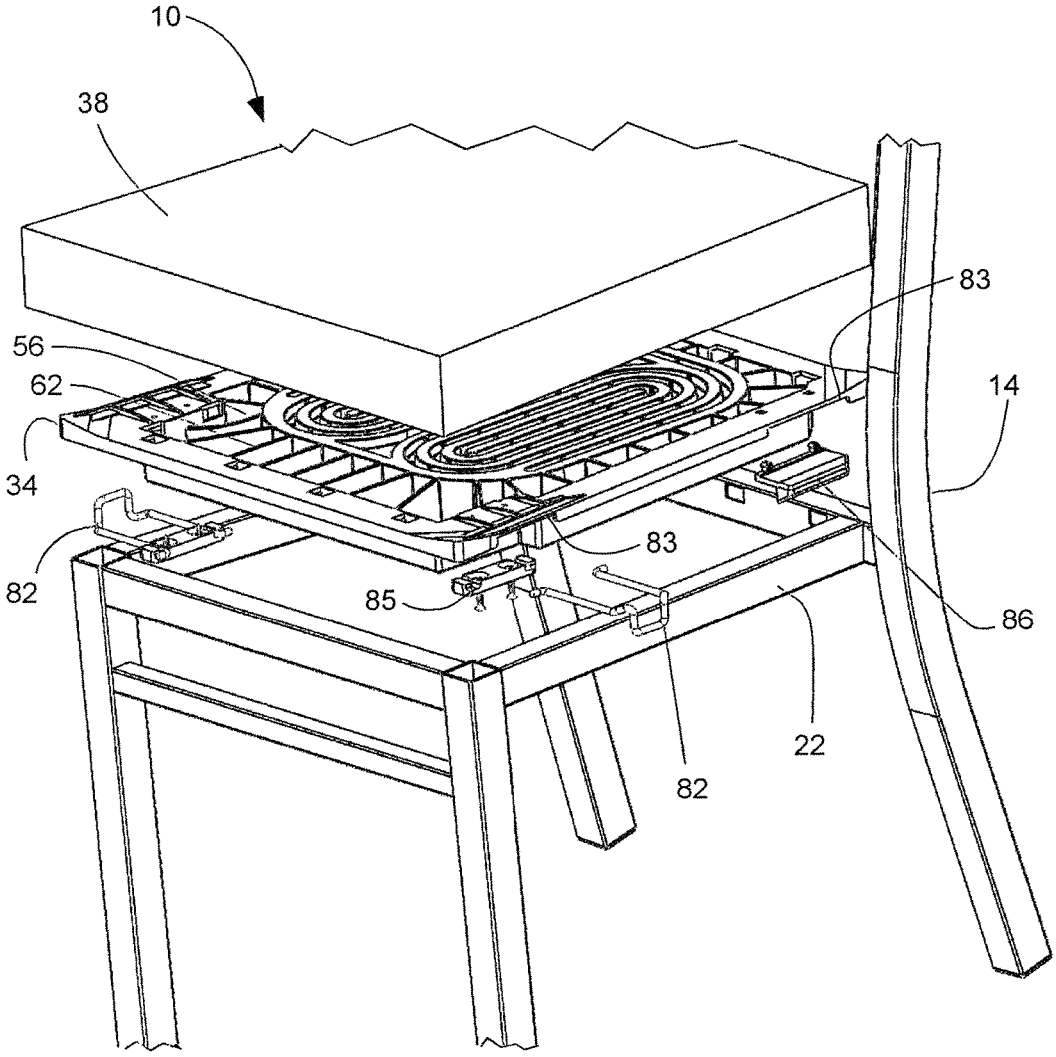
FIG. 4 is a partial exploded perspective view of the chair of FIG. 1.
Figure 5:
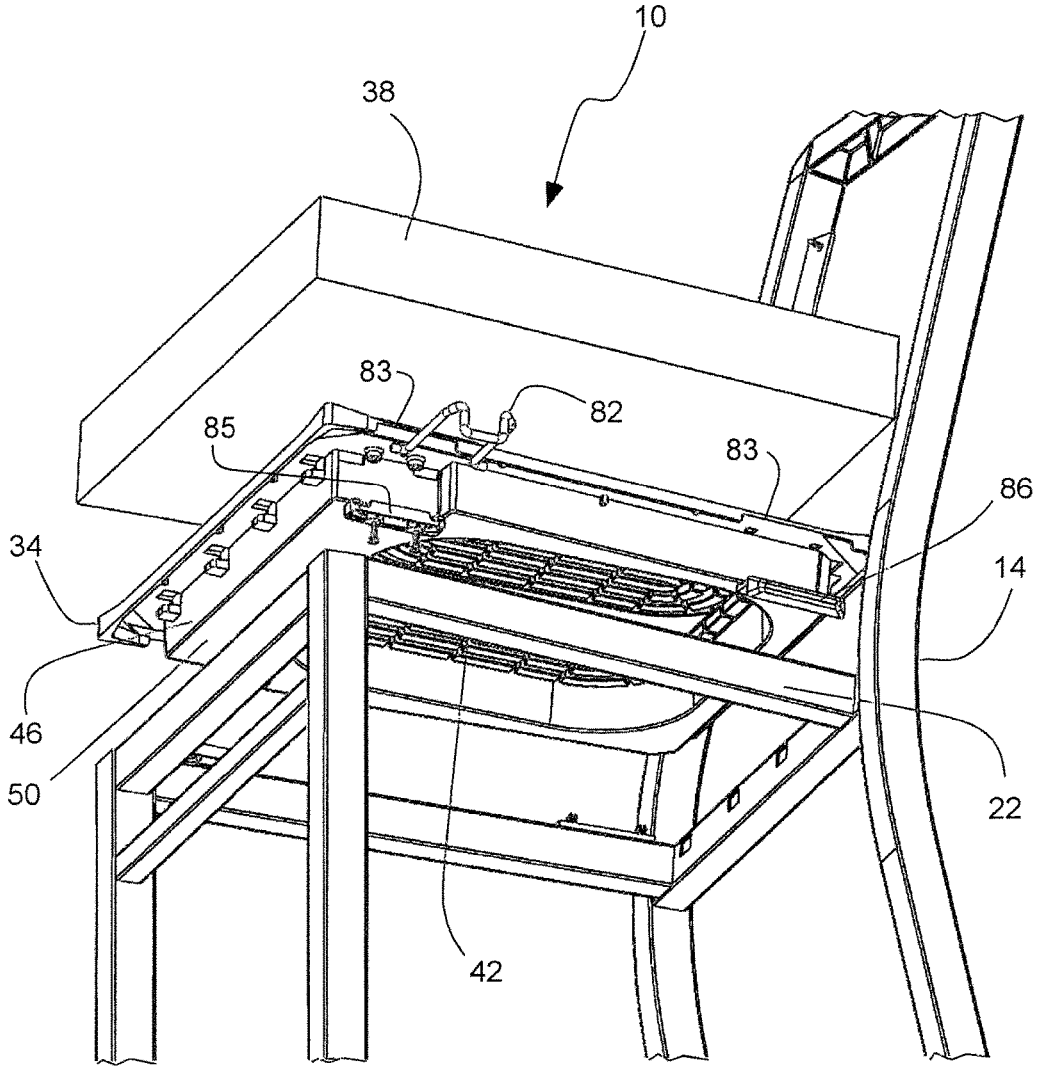
FIG. 5 is a partial exploded perspective view of the chair of FIG. 1.
Figure 6:
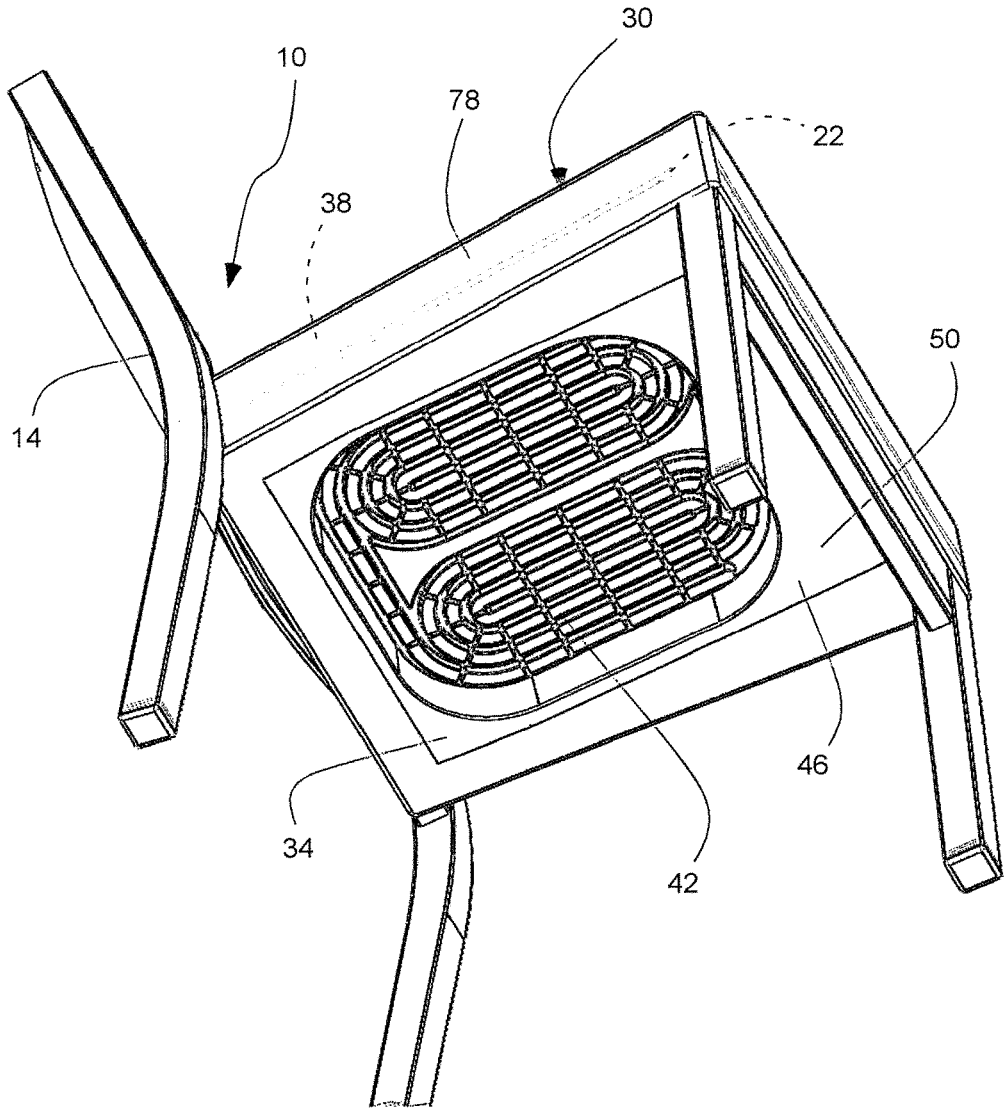
FIG. 6 is a partial bottom perspective view of the chair of FIG. 1.

In the Figures, a backrest panel of the backrest has been removed for illustrative purposes of the rest of the chair.

In some of the Figures, a cover layer of the seat has been removed to illustrate other components of the seat.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As illustrated in FIG. 1-9, a chair, indicated generally at 10, in an example implementation in accordance with the invention is shown. The chair can be a banquet style chair that can be provided with a thick cushion, and configured to be stacked together for storage with at least another lower chair. In addition, the chair can include a ganging member to gang to an adjacent chair. In addition, the chair can have a fabric wrap over a seat, and the seat can be configured to facilitate the use of the fabric wrap and fastening the fabric wrap to the seat. Furthermore, the seat can have a top bar that can be coupled to open tubes of the chair.

The chair 10 has a frame 14 with a plurality of legs 18, such as four legs including a pair of front legs and a pair of rear legs. The legs can be oriented substantially vertically, and located in a generally square configuration. The rear legs can have an inward incline, such as an acute angle with respect to vertical, to facilitate stacking and/or nesting of the chair with another chair. In addition, the frame has a seat hoop 22 that is carried by and/or disposed atop the legs 18. Thus, the seat hoop can be disposed intermediate the frame, or between the legs and a backrest. The seat hoop can be oriented substantially horizontally, but can have a slight (or acute) incline with respect to horizontal for comfort. The seat hoop can be formed with, or partially by, the legs, with the legs forming corners of the seat hoop. Furthermore, the frame has a backrest 26 that extends above the seat hoop, and behind the seat hoop. The backrest can include or can be supported by backrest supports. The backrest supports can be formed by the rear legs extending above the seat hoop. The backrest supports and/or an upper portion of the rear legs above the seat hoop can be substantially vertical, but with a slight (or acute) outward incline or angle with respect to vertical, opposite that of the bottom portion of the rear legs, for comfort. Thus, the backrest supports and/or an upper portion of the rear legs above the seat hoop can form an obtuse angle with respect to the seat hoop (or seat) for comfort, and/or to facilitate stacking with another chair. The legs, seat hoop, and backrest support can be formed of tubes or tubing. The tubing can have a rectangular or square or round cross-sectional shape. The tubing can be metal, such as aluminum. The tubing of the legs and seat hoop can be welded together. The seat hoop can have front and rear spars coupled between the front and rear legs respectively; and lateral side spars coupled between the front and rear legs on opposite sides, to form the seat hoop, and to coupled the legs together. The seat hoop has a hoop thickness between upper and lower surfaces of the hoop, or the upper and lower surfaces of the tubing of the seat hoop. The thickness of the seat hoop can be the same as a width of the legs.

A seat 30 is carried by the seat hoop 22 of the frame 14. The seat comprises a seat base 34 with a cushion 38. The cushion can be flexible and resilient. For example, the cushion can be or can include a block of foam. The seat base 34 can be relatively rigid compared to the cushion, and can be formed of plastic such as by injection molding, so that the seat base is formed as a single continuous monolithic body. The seat base 34 can have a perimeter lip 40 circumscribing the seat base and resting over the seat hoop 22. Thus, the seat base can span and cover the seat hoop or opening therein. In addition, the seat base 34 can have a flexible and resilient corrugated interior 42 capable of deflecting under weight and returning when the weight is removed. Thus, the structure of the seat base, although rigid, can be configured with ridges and channels to physically deflect under weight. Various aspects of the corrugated interior of the seat base are disclosed in U.S. Pat. No. 7,654,617, which is hereby incorporated herein by reference. The seat base 34 can provide support for the cushion 38 over the opening in the seat hoop. The cushion 38 and the corrugated interior 42 can together provide a comfortable, cushioned, support for the user to sit on.

The seat base or corrugated interior can have a number of accordion-like flex elements which interact under load to form a highly flexible seat member or platform, with a top surface that provides firm support to the cushion while simultaneously flexing to conform to the body shape of the user and reduce the number of pressure points. Although the flex elements can interact with each other in an intricate fashion, the seat base can be made from common, low-cost synthetic materials, such as plastic, polypropylene, polyethylene, nylon or equivalent polymer materials. This also allows for simple high-volume manufacturing techniques, such as injection molding, which can lead to economical and inexpensive production.

Formed in the interior portion of the seat base can be a pair of flex elements, or adjacent, corrugated regions which are disposed side-by-side and configured for flexibly supporting the buttocks of the user. The corrugated regions can further be defined as a series of alternating ribs and slots having rib tops and slot bottoms, and which can be connected by substantially vertical sidewalls. The rib tops can be co-planar with the top surface of the seat base in a non-flexed or unloaded condition, while the slot bottoms can be disposed below the seat surface.

The pair of adjacent, side-by-side corrugated regions can be surrounded by a third flex element or corrugated region, which is concentric with the interior pair and configured for flexibly supporting the hips and thighs of the user, and which can have similar alternating ribs and slots having rib tops and slot bottoms, and which can also be connected by substantially vertical sidewalls.

The pair of corrugated regions can each include a center bar which can define the center of the region, and which can align with the projected contact points of the buttocks of the user. The center bar can be a rib top. Alternatively, the center bar can be configured as a slot bottom to provide for more flexibility in the center and define a contact ring as providing the innermost contact point on the top surface. In like fashion, the transition rib or bar and associated triangular slots, which together bridge the gap between the pair of interior corrugated regions and the third surrounding corrugated region, can be reversed between rib tops or slot bottoms in an alternative aspect of the present invention. In other words, the transition bar can be configured as a transition slot, and the triangular slots can be likewise configured as triangular ribs.

A variety of alternating rib and slot configurations can be included within the scope of the present invention, to allow balancing of the degree of support versus the degree of elasticity provided by the pair of side-by-side corrugated regions and the third surrounding corrugated region, and to provide flexibility when fine-tuning the support and flexibility characteristics of the seat base. For instance, the width of the rib tops can be greater than the width of the slot bottoms, the ratio between the rib top width and slot bottom width can vary across the seat surface, or the depth of the slots can change between adjacent corrugations, etc.

The alternating ribs and slots in the corrugated regions can be configured to form a plurality of discrete rows. The discrete rows can be oblong or annular, and can form a series of complete rings. The rings can be further described as a series of complete interior rings concentric with the center bars of the interior pair of corrugated regions, and a series of complete exterior rings in the third concentric region that are concentric with the center of the seat base.

Figure 7:
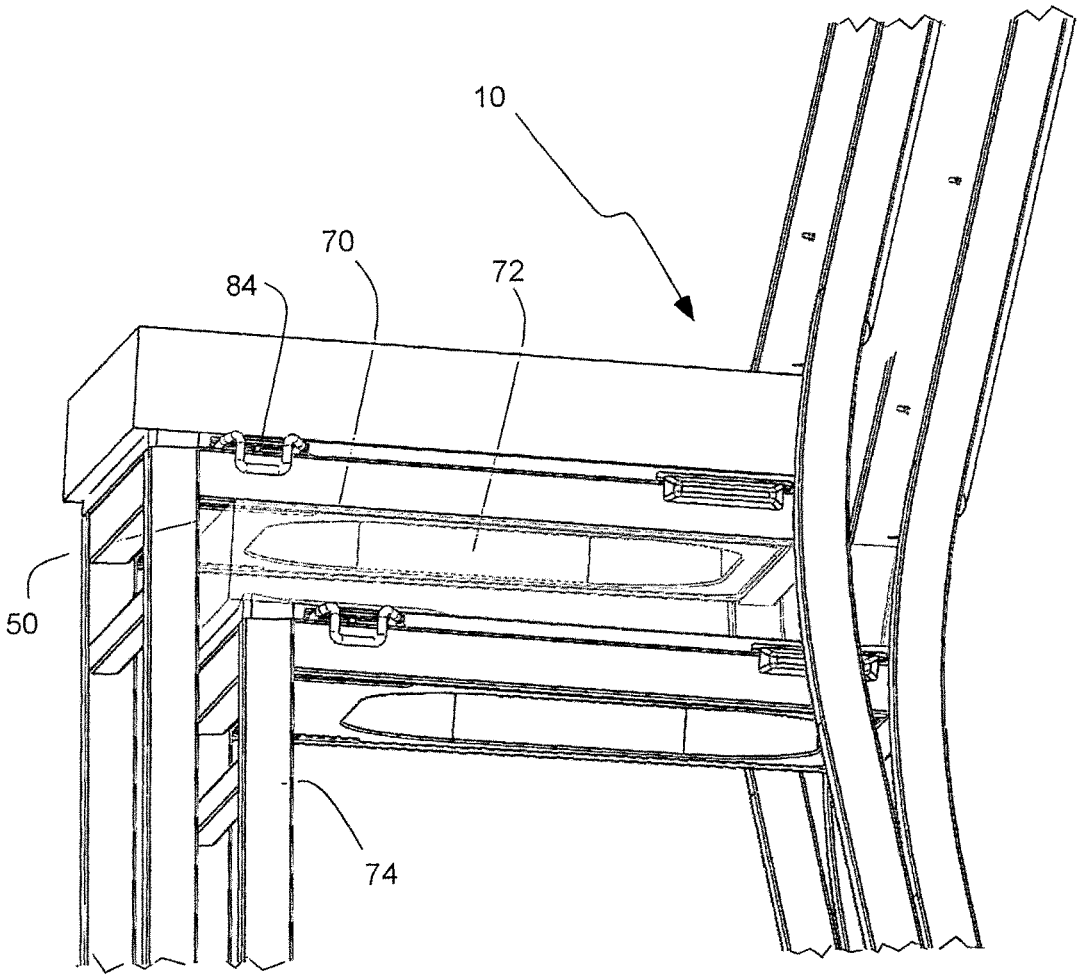
FIG. 7 is a partial side perspective view of the chair of FIG. 1, shown in a stacked configuration with a lower stacked chair.
Figure 8:
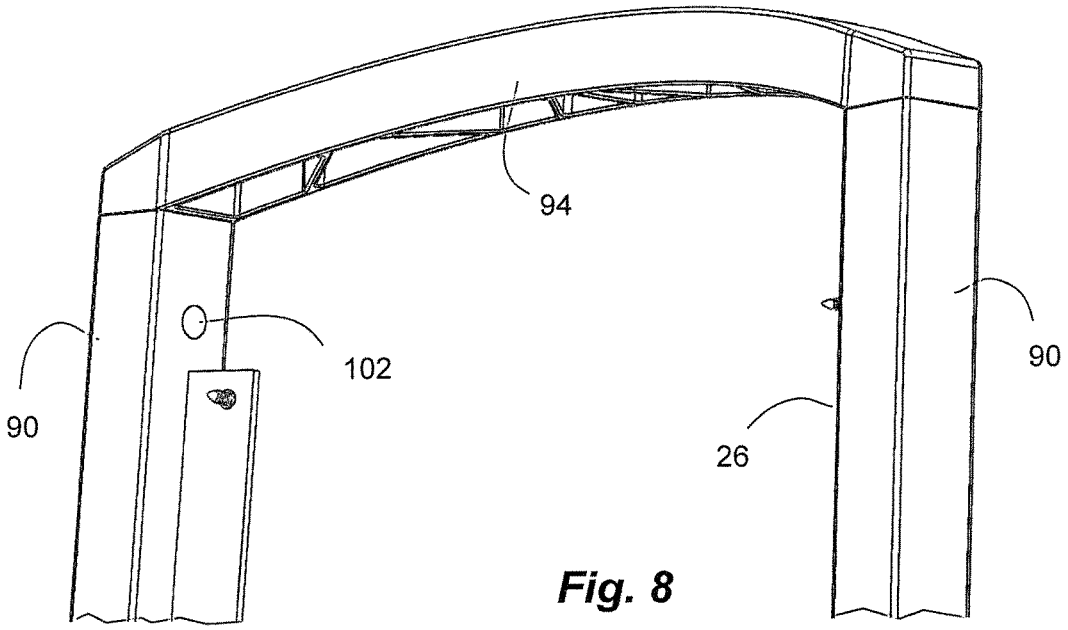
FIG. 8 is a partial perspective view of the chair of FIG. 1.
Figure 9:
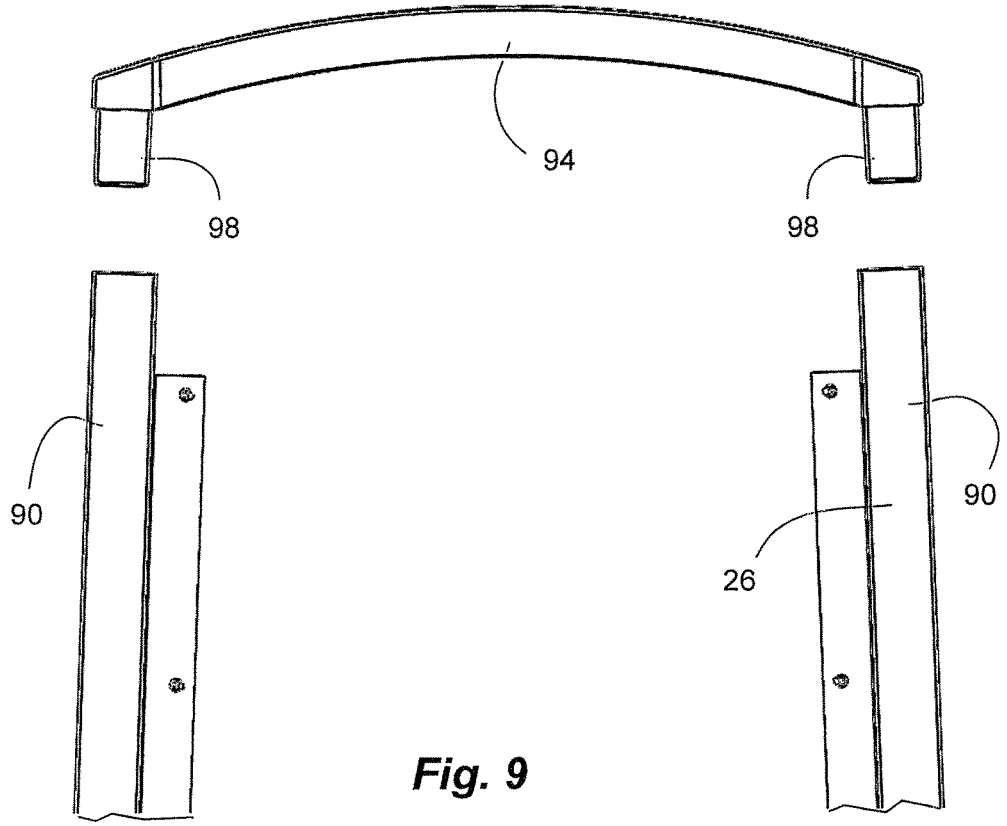
FIG. 9 is a partial exploded perspective view of the chair of FIG. 1.

In addition, the seat base 34 has a bottom projection 46 projecting from the seat base and into the seat hoop. The bottom projection can have a bottom surface 50 substantially flush with the lower surface 54 of the seat hoop. Thus, the seat hoop can provide the bottom surface thereof at the bottom of the seat hoop even though the seat base is disposed atop the seat hoop. The bottom projection can be an annular bottom projection projecting from the seat base between the perimeter lip 40 and the corrugated interior 42, and the bottom surface can be an annular bottom surface. The seat base 34 has a thickness greater than the seat hoop, and extends from the lower surface of the seat hoop to above the seat hoop. Thus, the seat base can provide the bottom surface while having the corrugated interior 42. The annular bottom projection can be formed by an annular groove 56 in the upper surface of the seat base between the perimeter lip and the corrugated interior, and corresponding to the annular bottom projection in the lower surface. The annular groove allows the annular bottom projection to be formed in the seat base as a single continuous monolithic piece. A plurality of radial fins 62 can be spaced-apart in the annular groove and oriented radially to extend between inner and outer walls of the annular groove. The fins can provide structural support. The annular bottom projection can substantially fill a lateral space between the seat hoop and the corrugated interior. Thus, the surface area of the bottom surface is maximized between the seat hoop and the corrugations. The bottom surface 50 of the seat base 34 is capable of abutting to a top 70 of a seat 72 of a lower chair 74 when stacked thereon to resist the seat hoop from sinking into the seat of the lower chair, as shown in FIG. 7.

In addition, the seat 30 can further comprise a cover layer 78 wrapped over the cushion 38 and the seat hoop 22, and fastened to the annular bottom surface 50 of the seat base. For example, the cover layer can include a fabric wrap, the edges of which can be stapled and/or adhered to the bottom surface of the seat base. Thus, the bottom surface 50 of the seat base and its location at a bottom of the seat hoop facilitates the addition of a cover layer, that can extend around the cushion, seat base, and seat hoop.

A ganging member, such as a ganging rod 82, can be affixed to the seat base 34 and can extend laterally beyond the seat hoop 22 between the perimeter lip 40 of the seat base and the seat hoop. The rod 82 can be bent in a U-shape, and can have free ends affixed to the seat base, horizontal arms resting over the seat hoop, and a closed end bent to extend vertically. The free ends of the rod can be sandwiched between the seat base and a clip, with the clip secured to the seat base by fasteners, such as screws. The ganging member or rod can be capable of engaging another ganging member of an adjacent chair. The ganging member or rod, or portion thereof such as the horizontal arms, can be sandwiched between the seat base, or perimeter rim, and the seat hoop. Thus, the fasteners at the free ends, and the sandwich of the horizontal arms intermediate the rod, provides two points of attachment or support for the ganging member or rod.

In one aspect, the ganging member can comprise a plurality of ganging members, including a male-type ganging member and a female-type ganging member. At least one male-type ganging member can be disposed on one side of the seat base, seat, frame or seat hoop. At least one female-type ganging member can be disposed on another opposite side of the seat base, seat, frame or seat hoop. The male and female ganging members can be the same, but oriented in different up and down directions. The seat base is configured to secure the ganging members in a way that allows them to be extended and retracted. There can be one male-type ganging member on each chair, or there can be two or more. Additionally, there can be one female-type ganging member on each chair, or there can be two or more. The male-type ganging member can be configured to engage a single female-type ganging member of an adjacent chair, or two or more. Similarly, the female-type ganging member can be configured to engage a single male-type ganging member of an adjacent chair, or two or more. The male-type ganging member(s) and the female-type ganging member(s) engage to interlock adjacent chairs. As indicated above, the ganging-members can be made from stainless steel wire or rod or other suitable material bent into a U-shaped member to extend from the seat base of the seat and the seat hoop of the frame. A closed end of the U-shaped member can extend from the seat base and seat hoop of the frame. The open end of the U-shaped member, or the free ends thereof, can be bent at right angles to retain the member to the seat base of the seat. The closed end of the U-shaped member can be bent at a right angle with respect to parallel arms of the U-shaped member. The male-type ganging member can have a narrower width or end than the female-type ganging member.

In another aspect, at least one notch 83 can be formed in a lower edge of the seat base of the seat. The notch 84 can form an aperture 84 between the notch and the seat hoop of the frame. The notch can be configured to allow the at least one male-type ganging member or the at least one female-type ganging member to extend from the aperture 84 between the seat base 34 of the seat and the seat hoop 22 of the frame. The ganging members can extend and retract slidably through the notch and/or aperture.

In another aspect, at least one guide 85 can be attached to the bottom of the seat base 34 of the seat to direct and stabilize the male-type ganging member and/or the female-type ganging member. The guide 84 can be attached to the seat base using at least one screw, nail, clamp, clip, wire, adhesive, or other suitable means. The guide 85 can slidably clamp the ganging member, or parallel arms of the U-shaped member, to the bottom of the seat base to allow the ganging member to extend and retract from the seat base. The seat base can be formed of injection molded plastic and can have an interior with structural ribs that projects into a space between the seat frame, and a perimeter lip that rests on the seat frame. The ganging member, or arms of the U-shaped member, can extend through one or more apertures in a vertical wall that opposes the notch. In addition, upper ribs can be formed on the upper surface or side of the base, or the perimeter lip thereof, above the notch to strengthen the seat base at the notch. The vertical wall can circumscribe the interior of the seat base, and can extend vertically downwardly from the perimeter lip. The guide can be located in a notch of the vertical wall that is spaced apart from the interior of the seat base.

In addition, a bumper 86 can be affixed to the seat base 34, and can extend laterally beyond the seat hoop between the perimeter lip of the seat base and the seat hoop. The bumper can be formed of a flexible or less rigid material than the plastic of the seat base and metal of the frame. The bumper can be snap-fit, or have snap fasteners, to attach to the seat base. Again, bumper can have two points of attachment or support, similar to the ganging member or rod. The bumper can abut to an adjacent chair or corresponding bumper of the adjacent chair. The bumper can similarly extend from an aperture defined between a notch of the base and the seat frame. The bumper can have collapsible enlarged heads that extend into apertures in the base so that the bumper can be snap fit to the base.

As described above, the backrest can have a pair of backrest supports which can include a pair of elevated, open-ended tubes 90. The backrest can also include a horizontal top bar 94 spanning the pair of tubes. The top bar can have a pair of legs 98 that can extend into open-ends of the pair of tubes 90. The top bar can be formed by casting and can include a metal material, such as aluminum. A dimple 102 can be formed in the pair of tubes 90 at the pair of legs 98 to retain the pair of legs in the pair of tubes. The backrest can include a panel carried by and coupled to the backrest supports (but which is removed from the drawings for illustrative purposes).

The seat hoop 22 can have a plurality of holes 108 in an interior wall of the seat hoop. The seat base 34 can have a plurality of corresponding tabs 110 corresponding to the plurality of holes to retain the seat base to the seat hoop. The tabs on at least one side of the seat base can be angled, or have angled surfaces. Thus, the seat base can be press fit to the seat hoop without additional fasteners.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A chair device, comprising:

a) a frame having legs, a seat hoop carried by the legs, and a backrest extending above the seat hoop, the seat hoop having a thickness between upper and lower surfaces;

b) a seat carried by the seat hoop of the frame, and having a seat base with a cushion thereon;

c) the seat base having a perimeter lip circumscribing the seat base and resting over the seat hoop; and d) a ganging member affixed to the seat base and extending laterally beyond the seat hoop between the perimeter lip of the seat base and the seat hoop of the frame, configured to engage another ganging member of an adjacent chair.

2. The chair device in accordance with claim 1, wherein the ganging member is slidably coupled to the seat base so that the ganging member can extend and retract with respect to the seat base.

3. The chair device in accordance with claim 1, wherein the ganging member comprises a rod bent in a U-shape and having free ends affixed to the seat base, horizontal arms resting over the seat hoop, and a closed end bent to extend vertically.

4. The chair device in accordance with claim 1, further comprising:

a notch formed in a lower edge of the seat base of the seat and forming an aperture between the notch and the seat hoop of the frame; and the ganging member extending from the aperture between the seat base of the seat and the seat hoop of the frame.

5. The chair device in accordance with claim 1, further comprising:

a bumper affixed to the seat base and extending laterally beyond the seat hoop between the perimeter lip of the seat base and the seat hoop of the frame, configured to abut to an adjacent chair or corresponding bumper of the adjacent chair.

6. The chair device in accordance with claim 1, further comprising:

a guide disposed on a bottom of the seat base of the seat and clamping the ganging member to the bottom of the seat base.

7. The chair device in accordance with claim 1, wherein the ganging member comprises:

at least one male-type ganging member disposed on one side of the seat base;

at least one female-type ganging member disposed on another opposite side of the seat base; and the at least one male-type ganging member being configured to engage at least one female-type ganging member of an adjacent chair, the at least one female-type ganging member being configured to engage at least one male-type ganging member of another adjacent chair; wherein adjacent male-type and female-type ganging members engage and interlock.

8. The chair device in accordance with claim 1, further comprising:

a bottom projection projecting from the seat base and into the seat hoop, and having a bottom surface substantially flush with the lower surface of the seat hoop.

9. The chair device in accordance with claim 1, wherein the seat base has a thickness greater than the seat hoop and extends from the lower surface of the seat hoop to above the seat hoop.

10. The chair device in accordance with claim 1, further comprising:

a) the seat base having a flexible and resilient corrugated interior capable of deflecting under weight and returning when the weight is removed; and b) the seat base having an annular bottom projection projecting from the seat base between the perimeter lip and the corrugated interior and into the seat hoop, and having an annular bottom surface substantially flush with the lower surface of the seat hoop; and c) the seat base being formed as a single continuous monolithic body.

11. The chair device in accordance with claim 10, wherein the annular bottom surface of the seat base abuts to a top of a seat of a lower chair when stacked thereon to resist the seat hoop from sinking into the seat of the lower chair.

12. The chair device in accordance with claim 1, further comprising:

a plurality of holes in an interior wall of the seat hoop; and a plurality of corresponding tabs on the seat base.

13. A chair device, comprising:

a) a frame having legs, a seat hoop carried by the legs, and a backrest extending above the seat hoop, the seat hoop having a thickness between upper and lower surfaces;

b) a seat carried by the seat hoop of the frame, and having a seat base with a cushion thereon;

c) a perimeter lip circumscribing the seat base and resting over the seat hoop;

d) a bottom projection projecting from the seat base and into the seat hoop, and having a bottom surface substantially flush with the lower surface of the seat hoop;

e) at least one male-type ganging member disposed on one side of the seat base;

f) at least one female-type ganging member disposed on another opposite side of the seat base;

g) the at least one male-type ganging member and the at least one female-type ganging member affixed to the seat base and extending laterally beyond the seat hoop between the perimeter lip of the seat base and the seat hoop of the frame; and h) the at least one male-type ganging member being configured to engage at least one female-type ganging member of an adjacent chair, the at least one female-type ganging member being configured to engage at least one male-type ganging member of another adjacent chair; wherein adjacent male-type and female-type ganging members engage and interlock.

14. The chair device in accordance with claim 13, wherein each of the at least one male-type ganging member and the at least one female-type ganging member is slidably coupled to the seat base to extend and retract with respect to the seat base.

15. The chair device in accordance with claim 13, further comprising:

a pair of notches each formed in a lower edge of the seat base of the seat on opposite sides of the seat base, and forming a pair of apertures between the pair of notches and the seat hoop of the frame; and each of the at least one male-type ganging member and the at least one female-type ganging member extending from different ones of the pair of apertures between the seat base of the seat and the seat hoop of the frame.

16. The chair device in accordance with claim 13, wherein each of the at least one male-type ganging member and the at least one female-type ganging member comprises a rod bent in a U-shape and having free ends affixed to the seat base, horizontal arms resting over the seat hoop, and a closed end bent to extend vertically.

17. The chair device in accordance with claim 13, further comprising:

a pair of guides disposed on a bottom of the seat base of the seat and each clamping a different one of the at least one male-type ganging member and the at least one female-type ganging member to the bottom of the seat base.

18. A chair device, comprising:

a) a frame having legs, a seat hoop carried by the legs, and a backrest extending above the seat hoop, the seat hoop having a thickness between upper and lower surfaces;

b) a seat carried by the seat hoop of the frame, and having a seat base with a cushion thereon;

c) a perimeter lip circumscribing the seat base and resting over the seat hoop;

d) a bottom projection projecting from the seat base and into the seat hoop, and having a bottom surface substantially flush with the lower surface of the seat hoop;

e) a ganging member affixed to the seat base and extending laterally beyond the seat hoop between the perimeter lip of the seat base and the seat hoop of the frame, configured to engage another ganging member of an adjacent chair;

f) a notch formed in a lower edge of the seat base of the seat and forming an aperture between the notch and the seat hoop of the frame; and the ganging member extending from the aperture between the seat base of the seat and the seat hoop of the frame; and g) the ganging member is slidably coupled to the seat base so that the ganging member can extend and retract with respect to the seat base.

19. The chair device in accordance with claim 18, wherein the ganging member comprises a rod bent in a U-shape and having free ends affixed to the seat base, horizontal arms resting over the seat hoop, and a closed end bent to extend vertically.

20. The chair device in accordance with claim 18, further comprising:

a guide disposed on a bottom of the seat base of the seat and clamping the ganging member to the bottom of the seat base.

* * * * *